US008277326B2

(12) United States Patent
Kuhn et al.

(10) Patent No.: US 8,277,326 B2
(45) Date of Patent: Oct. 2, 2012

(54) REMOVABLE PLAYER STATION AND LOCKING MECHANISM FOR ELECTRONIC GAMES

(75) Inventors: Tyler V. Kuhn, Spokane, WA (US); Donald L. Evans, Spokane, WA (US)

(73) Assignee: DigiDeal Corporation, Spokane, WA (US)

( * ) Notice: Subject to any disclaimer, the term of this patent is extended or adjusted under 35 U.S.C. 154(b) by 906 days.

(21) Appl. No.: 12/353,263

(22) Filed: Jan. 14, 2009

(65) Prior Publication Data

US 2010/0178989 A1 Jul. 15, 2010

(51) Int. Cl.

| | |
|---|---|
| ***A63F 9/24*** | (2006.01) |
| ***A63F 13/00*** | (2006.01) |
| ***G06F 17/00*** | (2006.01) |
| ***G06F 19/00*** | (2006.01) |
| ***A63B 67/00*** | (2006.01) |
| ***A63B 69/02*** | (2006.01) |

(52) U.S. Cl. ..... 463/46; 463/47

(58) Field of Classification Search ..... 463/46, 463/47; 273/309, 148 B

See application file for complete search history.

(56) References Cited

U.S. PATENT DOCUMENTS

| | | | |
|---|---|---|---|
| 2,519,681 | A | 8/1950 | Mages |
| 3,049,001 | A | 8/1962 | Mackay et al. |
| 3,070,087 | A | 12/1962 | Sittel |
| 3,181,351 | A | 5/1965 | Stauffer |
| 3,796,433 | A | 3/1974 | Fraley et al. |
| 4,072,310 | A | 2/1978 | Beam |
| 4,294,451 | A | 10/1981 | Wollner |
| 4,380,334 | A | 4/1983 | Minkoff et al. |
| 4,531,187 | A | 7/1985 | Uhland |
| 4,614,342 | A | 9/1986 | Takashima |
| 4,636,951 | A | 1/1987 | Harlick |
| 4,760,527 | A | 7/1988 | Sidley |
| 4,813,675 | A | 3/1989 | Greenwood |

(Continued)

FOREIGN PATENT DOCUMENTS

GB 2117546 A * 10/1983

OTHER PUBLICATIONS

Smlcoop ("It is easy to yank a Kensington cable out of the slot" Youtube http://www.youtube.com/watch?v=Ge6sh4srzbl published Aug. 14, 2007).*

*Primary Examiner* — N Drew Richards
*Assistant Examiner* — Grant Withers
(74) *Attorney, Agent, or Firm* — Mark Farrell Patent Law PC

(57) ABSTRACT

A removable player station and locking mechanism. In one implementation, a removable player station allows quick and secure replacement, swapping, and upgrade of a modular player station component for electronic games. In one context, an electronic game table may employ multiple of the removable player stations, each secured with a locking mechanism and a common or a unique lock. In one implementation of a latching mechanism, a pivotable cradle attaches to the electronic game or game table and seats the removable player station through a pivoting motion that also brings the cradle into a locking position. When the pivotable cradle is opened from the locking position, the cradle lifts the removable player station from the game or tabletop for easy manual removal. The accessible part of the locking mechanism may be located under an electronic game tabletop away from view of the players.

16 Claims, 8 Drawing Sheets

U.S. PATENT DOCUMENTS 4,926,327 A 5/1990 Sidley
5,022,653 A 6/1991 Suttle et al.
5,033,744 A 7/1991 Bridgeman et al.
5,046,736 A 9/1991 Bridgeman et al.
5,098,107 A 3/1992 Boylan et al.
5,141,234 A 8/1992 Boylan et al.
5,224,706 A 7/1993 Bridgeman et al.
5,242,163 A 9/1993 Fulton
5,255,915 A 10/1993 Miller
5,332,219 A 7/1994 Marnell, II et al.
5,377,973 A 1/1995 Jones
5,377,993 A 1/1995 Josephs
5,393,057 A 2/1995 Marnell, II
5,407,199 A 4/1995 Gumina
5,423,551 A 6/1995 Stavinsky
5,496,032 A 3/1996 Okada
5,511,781 A 4/1996 Wood et al.
5,531,440 A 7/1996 Dabrowski et al.
5,531,448 A 7/1996 Moody
5,586,766 A 12/1996 Forte et al.
5,586,936 A 12/1996 Bennett et al.
5,613,912 A 3/1997 Slater
5,630,586 A 5/1997 Lowden
5,636,843 A 6/1997 Roberts
5,651,548 A 7/1997 French et al.
5,655,966 A * 8/1997 Werdin et al. ..... 463/25
5,669,817 A 9/1997 Tarantino
5,674,128 A 10/1997 Holch et al.
5,687,968 A 11/1997 Tarantino
5,735,742 A 4/1998 French
5,743,800 A 4/1998 Huard et al.
5,766,076 A 6/1998 Pease et al.
5,770,533 A 6/1998 Franchi
5,779,546 A 7/1998 Meissner et al.
5,788,230 A 8/1998 Krise et al.
5,788,574 A 8/1998 Ornstein et al.
5,803,808 A 9/1998 Strisower
5,831,527 A 11/1998 Jones, II et al.
5,839,960 A 11/1998 Parra et al.
5,845,907 A 12/1998 Wells
5,868,392 A 2/1999 Kraft
5,879,233 A 3/1999 Stupero
5,909,876 A 6/1999 Brown
5,919,090 A 7/1999 Mothwurf
5,934,672 A 8/1999 Sines et al.
5,934,998 A 8/1999 Forte et al.
5,944,315 A 8/1999 Mostashari
5,944,316 A 8/1999 Hernandez
5,951,397 A 9/1999 Dickinson
6,010,404 A 1/2000 Walker et al.
6,093,101 A 7/2000 Mourad
6,099,408 A 8/2000 Schneier et al.
6,116,808 A * 9/2000 Strassle et al. ..... 403/252
6,158,741 A 12/2000 Koelling
6,165,069 A 12/2000 Sines et al.
6,186,895 B1 2/2001 Oliver
6,200,218 B1 3/2001 Lindsay
6,203,008 B1 3/2001 Krise et al.
6,203,009 B1 3/2001 Sines et al.
6,217,447 B1 4/2001 Lofink et al.
6,270,404 B2 8/2001 Sines et al.
6,419,225 B2 7/2002 Sines et al.
6,419,226 B2 7/2002 Krise et al.
6,481,718 B2 11/2002 Koelling et al.
6,619,659 B2 9/2003 Krise et al.
6,641,137 B2 11/2003 Sines et al.
6,651,985 B2 11/2003 Sines et al.
6,722,974 B2 4/2004 Sines et al.
6,896,259 B2 5/2005 Sines et al.
RE38,982 E 2/2006 Forte et al.
7,048,629 B2 5/2006 Sines et al.
7,255,642 B2 8/2007 Sines et al.
7,400,508 B2 * 7/2008 Erickson et al. ..... 361/726
7,534,065 B2 * 5/2009 Rejman et al. ..... 403/328
7,771,269 B2 * 8/2010 Kuhn et al. ..... 463/22
7,775,887 B2 * 8/2010 Kuhn et al. ..... 463/46
7,780,512 B2 * 8/2010 Sines et al. ..... 463/13
7,803,051 B2 * 9/2010 Kuhn et al. ..... 463/36
7,806,770 B2 * 10/2010 Taxon ..... 463/46
7,833,097 B1 * 11/2010 Maddox et al. ..... 463/36
7,845,642 B2 * 12/2010 Krise ..... 273/292
7,878,892 B2 * 2/2011 Sines et al. ..... 463/12
7,905,776 B2 * 3/2011 Sines ..... 463/25
7,922,589 B2 * 4/2011 Kuhn et al. ..... 463/46
8,016,659 B2 * 9/2011 Kuhn et al. ..... 463/17
2004/0087374 A1 * 5/2004 Cole ..... 463/46
2005/0032564 A1 * 2/2005 Sines ..... 463/13
2005/0227627 A1 * 10/2005 Cyr et al. ..... 455/67.11
2006/0068868 A1 * 3/2006 Crawford et al. ..... 463/13
2006/0128476 A1 * 6/2006 Vitito ..... 463/46
2006/0199629 A1 * 9/2006 Sines et al. ..... 463/12
2006/0205472 A1 * 9/2006 Sines et al. ..... 463/16
2006/0246976 A1 * 11/2006 Sines ..... 463/13
2006/0264252 A1 * 11/2006 White et al. ..... 463/13
2007/0015561 A1 * 1/2007 Sines et al. ..... 463/12
2007/0049368 A1 * 3/2007 Kuhn et al. ..... 463/12
2007/0049369 A1 * 3/2007 Kuhn et al. ..... 463/12
2007/0072663 A1 * 3/2007 Kuhn et al. ..... 463/11
2007/0072664 A1 * 3/2007 Kuhn et al. ..... 463/11
2007/0142107 A1 * 6/2007 Kuhn et al. ..... 463/16
2007/0228098 A1 * 10/2007 Teeters ..... 224/633
2007/0281786 A1 * 12/2007 Kuhn et al. ..... 463/31
2008/0045327 A1 * 2/2008 Kuhn et al. ..... 463/22
2008/0146307 A1 * 6/2008 Kuhn et al. ..... 463/13
2008/0161099 A1 * 7/2008 Sines et al. ..... 463/20
2008/0268933 A1 * 10/2008 Sines et al. ..... 463/13
2008/0268939 A1 * 10/2008 Sines et al. ..... 463/20
2008/0268940 A1 * 10/2008 Sines et al. ..... 463/20
2009/0017888 A1 * 1/2009 Kuhn et al. ..... 463/13
2009/0054159 A1 * 2/2009 Gadda et al. ..... 463/46
2009/0082079 A1 * 3/2009 Kuhn et al. ..... 463/13
2009/0253503 A1 * 10/2009 Krise et al. ..... 463/31
2010/0041469 A1 * 2/2010 Kuhn et al. ..... 463/25
2010/0090404 A1 * 4/2010 Krise ..... 273/292
2010/0120536 A1 * 5/2010 Chatellier et al. ..... 463/40
2010/0121808 A1 * 5/2010 Kuhn ..... 706/50
2010/0123668 A1 * 5/2010 Kuhn et al. ..... 345/173
2010/0151953 A1 * 6/2010 Kuhn et al. ..... 473/15

* cited by examiner

REMOVABLE PLAYER STATION AND LOCKING MECHANISM FOR ELECTRONIC GAMES

BACKGROUND

Many game consoles and electronic game tables incorporate a player station at which the player sits or stands. The player station typically includes a video display, which may be an interactive touch screen display. Game controls, audio speakers, selection buttons, card readers, and other control devices, and user interface devices may also form part of the player station.

Whether a game console or game table has one or many player stations, the player stations are usually assembled as an integral part of the game device. From the manufacturer, the game or table may be shipped with the player stations in place, sometimes requiring a large and heavy shipping crate in which the more sensitive components of the player stations are not especially guarded from handling and shock forces.

Removal, replacement, and upgrade of a player station usually requires the same skill and labor intensity that dismantling any other integral part of a game machine or game table would require. What is needed is a way to quickly remove and reconnect a player station as a unit, for rapid testing, replacement, cleaning, swapping, and upgrading.

SUMMARY

A removable player station and locking mechanism. In one implementation, a removable player station allows quick and secure replacement, swapping, and upgrade of a modular player station component for electronic games. In one context, an electronic game table may employ multiple of the removable player stations, each secured with a locking mechanism and a common or a unique lock. In one implementation of a latching mechanism, a pivotable cradle attaches to the electronic game or game table and seats the removable player station through a pivoting motion that also brings the cradle into a locking position. When the pivotable cradle is opened from the locking position, the cradle lifts the removable player station from the game or tabletop for easy manual removal. The accessible part of the locking mechanism may be located under an electronic game tabletop away from view of the players.

This summary section is not intended to give a full description of removable player stations and locking mechanisms for electronic games, or to provide a list of features and elements. A detailed description of example embodiments follows.

DETAILED DESCRIPTION

Overview

Figure 1:
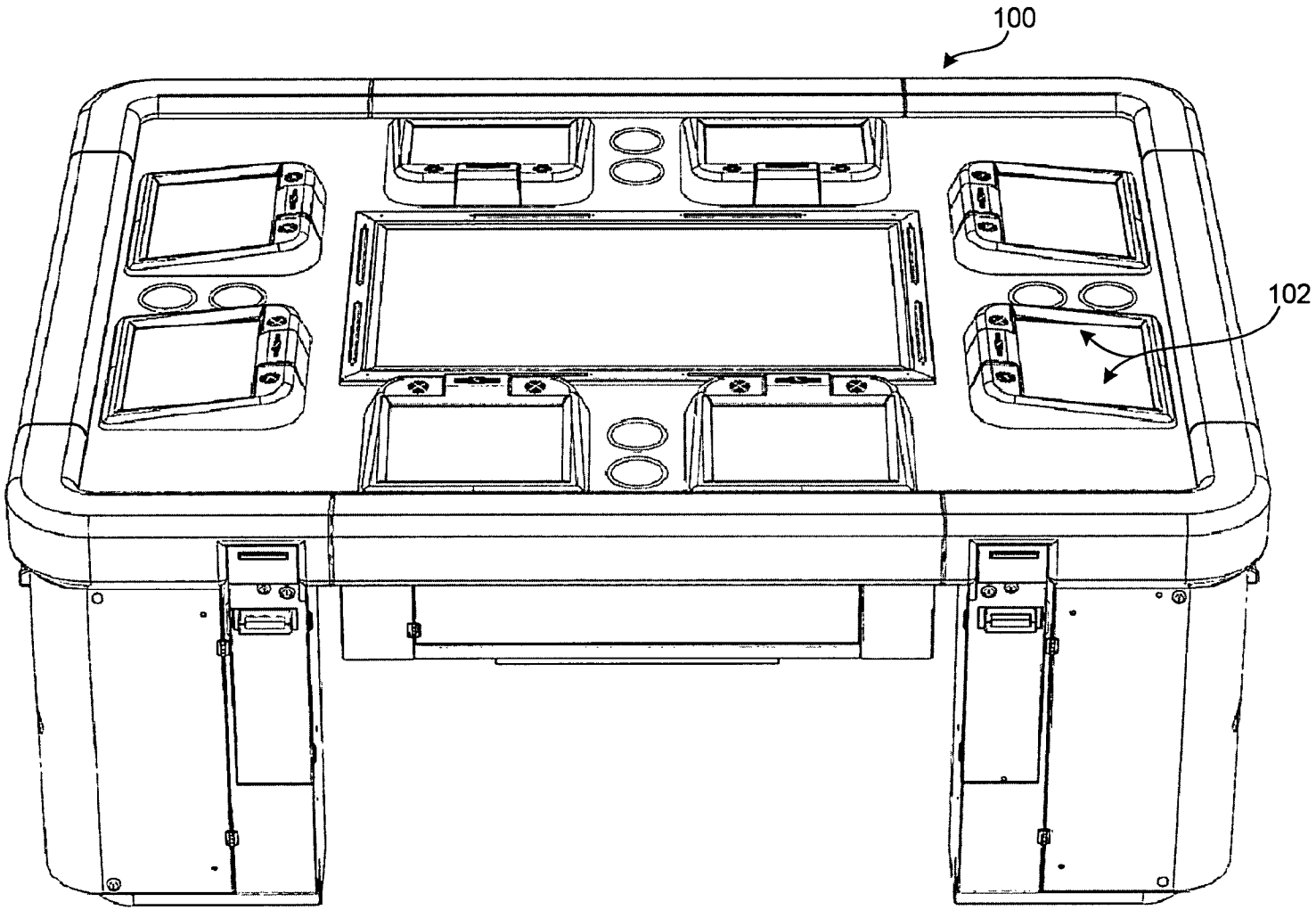
FIG. 1 is a diagram of an example electronic game table that includes removable player stations.

This disclosure describes removable player stations and associated locking mechanisms for electronic games. As shown in FIG. 1, various electronic games, such as an electronic game table 100, e.g., for gambling, may have one or more removable player stations 102 consisting of at least a video display. The video display may be a pure display, or may include touch screen interactive capability. Each removable player station 102 may also include an audio interface, additional game controllers and user interfaces, and other accessories, such as card readers, money processors, and so forth.

Figure 2:
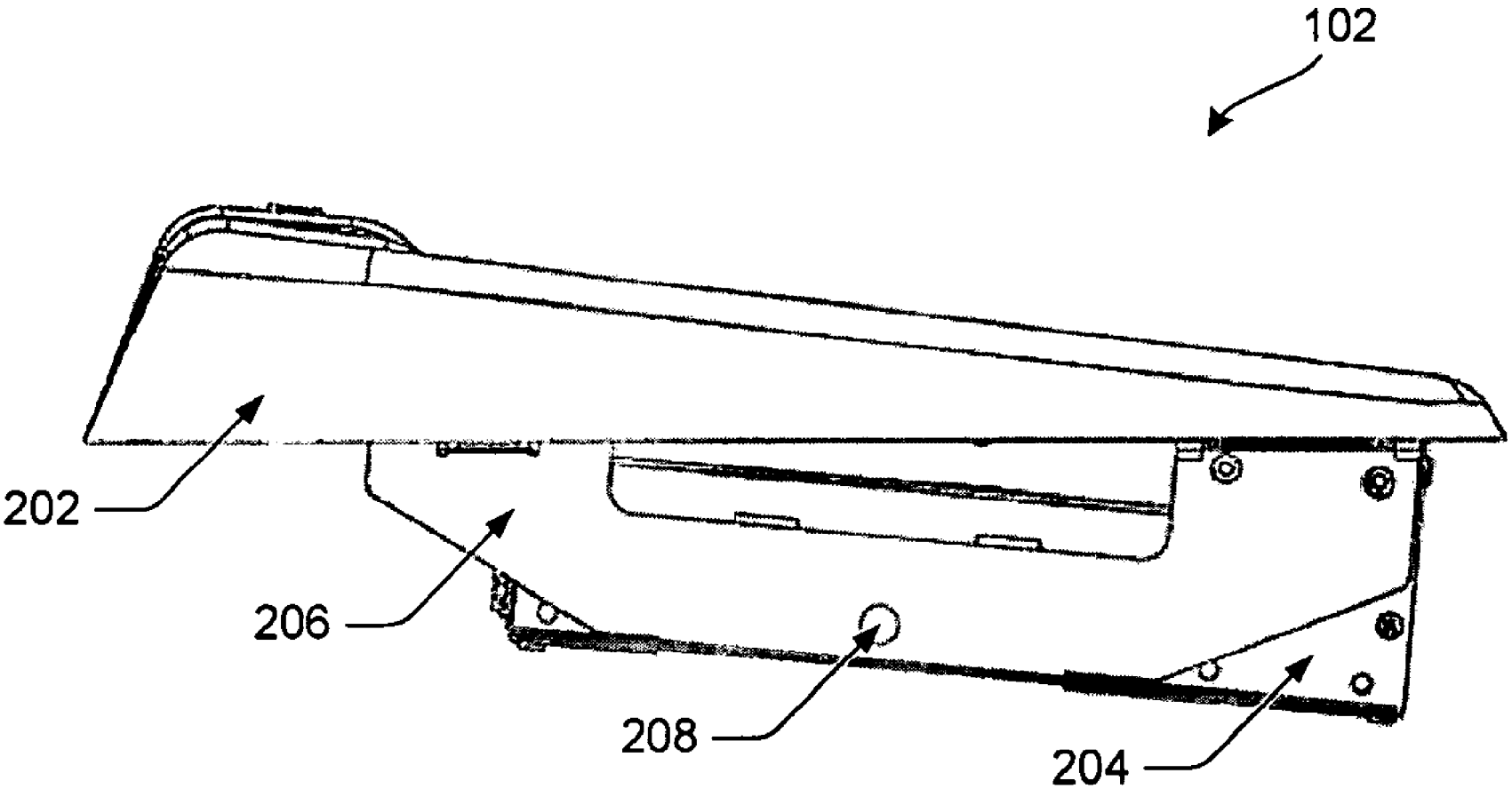
FIG. 2 is a diagram of an example removable player station.
Figure 4:
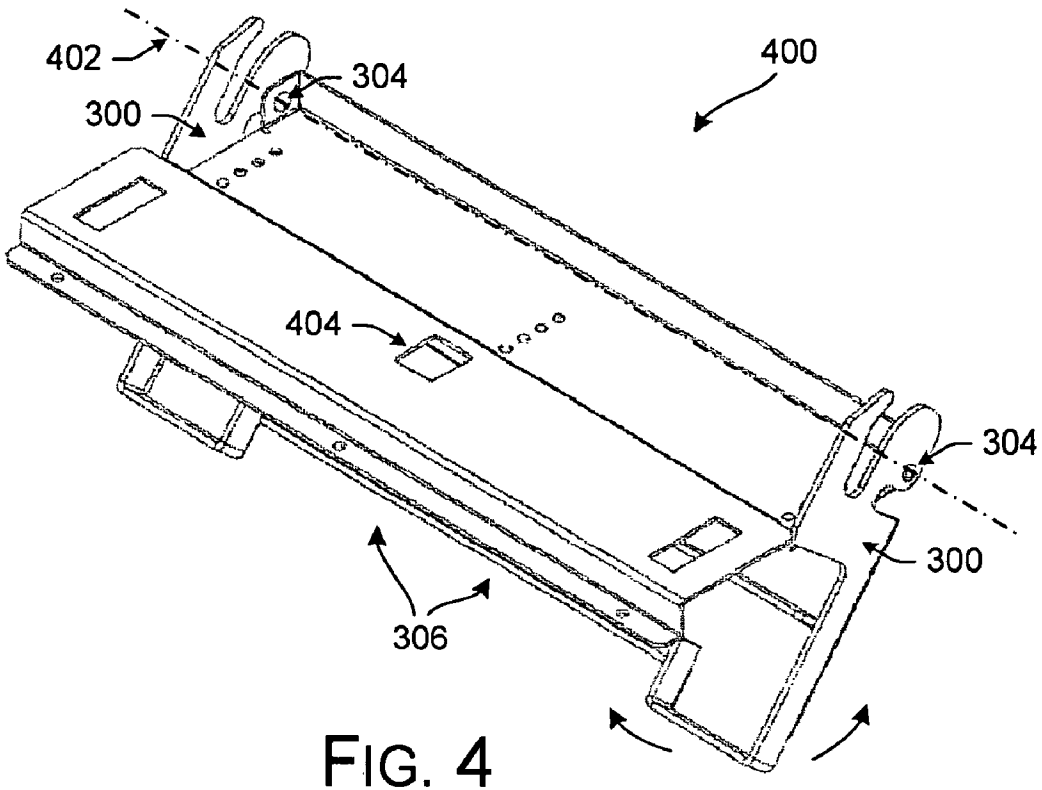
FIG. 4 is a diagram of an example pivoting cradle with multiple latches and locking capability.
Figure 3:
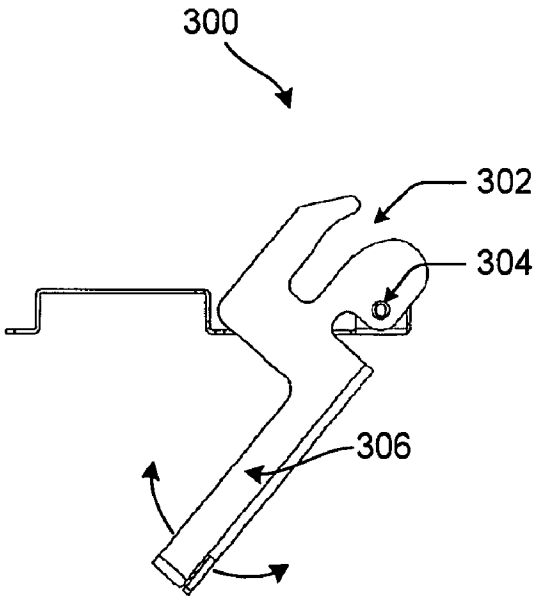
FIG. 3 is a diagram of an example pivoting latch.

In one implementation, as shown in FIG. 2, an example removable player station 102 consists of a module that can be quickly secured to or unsecured from electronic game hardware, such as the example electronic game table 100. For example, the electronic game table 100 may have openings in its tabletop fitted to accept the removable players stations 102 and as shown in FIGS. 3-4, a latch 300 or latching mechanism 400 that secures each removable player station 102 to the game or electronic game table 100 with very little effort and cable hook-up. In one implementation, the latching mechanism 400 is also referred to herein as a cradle 400.

In one implementation, returning to FIG. 1, each opening or player position at the example electronic game table 100 has a respective associated latching mechanism 400 that receives the removable player station 102 and allows a human operator to quickly secure the removable player station 102 to the electronic game table 100, e.g., by moving a lever, or pivoting a carriage or cradle. Further, the latching mechanism 400 may include a lock for securing the removable player station to the tabletop of the electronic game table 100. The lock and the lever parts of the latching mechanism 400 may be located underneath a game tabletop, away from view of the players.

The removable player station 102 and associated latch 300 and latching mechanisms 400 provide many benefits. Spare removable player station modules 102 may be stocked by a gambling establishment so that faulty player station modules 102 in an electronic game may be quickly replaced. Player stations 102 that become dirty may be swapped out for cleaning and maintenance. The ability to rapidly replace the removable player station modules 102 keeps the electronic game up and running.

When shipping a large electronic game or game table 100, the removable player station modules 102 and the quick-release latching mechanisms 400 enable the shipment to be broken down into smaller and lighter pieces that may afford better protection of sensitive components, and then assembled quickly and with minimal effort at the destination.

The removable player stations 102 also enable a game owner or the manufacturer to upgrade the player stations 102, without entailing skilled labor or a great deal of labor-hours to swap modules 102. Likewise, the removable player stations 102 allow an electronic game purchaser to acquire the game at low cost with low-end removable player stations 102, and effortlessly upgrade to better removable player stations 102 at a later date (e.g., higher resolution video, better audio, more sophisticated game controllers).

Example Electronic Game Table System

As introduced above, FIG. 1 shows an example electronic game table 100 that includes removable player stations 102. In the tabletop of the example electronic game table 100, each player position has an opening fitted to accept a removable player station 102. In the shown example, the electronic game table 100 has eight player positions with eight corresponding removable player stations 102. Thus, the electronic game table 100 also has eight separate latching mechanisms 400, one for each of the removable player stations 102.

The latching mechanism 400 associated with each opening in the tabletop removably secures the removable player station 102 to the electronic game table 100.

Example Removable Player Station Module

As introduced above, FIG. 2 shows an example removable player station module 102. The removable player station module 102 may have a cosmetic frame 202 that seats flush with the tabletop. Underneath tabletop surface level, the removable player station module 102 has a housing 204 that may contain electronics for the video display or other readout. When the removable player station module 102 constitutes all or part of a computer, the housing 204 may contain computing device components, such as a computing device processor, a computing device memory, or a computing device data storage medium. The housing 204 may also include electronics for additional game controllers and user interfaces, audio speakers, touch screen interface, card readers, and so forth.

In one implementation, the housing 204 is flanked by a carriage piece 206 on each side of the housing 204. Between each carriage piece 206 and the housing 204, a latch receiving member 208 ("receiving member" 208) is located for engaging the latch 300, e.g., of the latching mechanism 400. Depending upon implementation, the receiving member 208 may pivotably engage the latch 300. The latch 300 or latching mechanism 400 is movable to engage the receiving member 208 and secure the removable player station 102 to the electronic game table 100.

Example Latching and Locking Mechanisms

FIG. 3 shows the example latch 300 introduced above. In one implementation, each of one or more latches 300 employed to engage and secure the removable player station 102 is a rigid member that has an opening 302 to fit around the receiving member 208 of the removable player station 102. When the latch 300 is implemented as a pivoting member, a pivot point 304 fixes the latch 300 to the housing 204 and allows rotation around the pivot point 304. The latch 300 may have a side or end that serves as a lever 306, enabling a human operator to manually pivot the latch 300 to seat and secure the removable player station 102.

FIG. 4 shows the example pivoting cradle 400 introduced above. The shown cradle 400 may have locking capability and multiple latches 300. In one implementation, the cradle 400 is long enough so that the latches 300 fit on either side of the removable player station 102. However, in another implementation, the cradle has one or more latches 300 that engage the removable player station 102 through an opening in the housing 204 of the removable player station 102. Though such an opening, the latch 300 engages an internal receiving member 208.

Typically, the removable player station 102 has multiple receiving members 208 on more than one side of the housing 204 to secure the housing 204 to the electronic game table 100 at multiple points on the housing 204

When a cradle 400 with multiple latches 300 is used, the cradle 400 is attached to the electronic game table 100 at multiple pivot points 304 providing an axis of rotation 402 about which the cradle 400 can be pivoted. Likewise, the lever 306 part of the cradle 400 can be manually gripped at multiple points along the length of the cradle 400.

The cradle 400 may also include a lock, or depending on implementation, at least a lock opening 404 for accepting a lock to secure the cradle 400 to the electronic game table 100 in a seated, closed, locked position.

Figure 5:
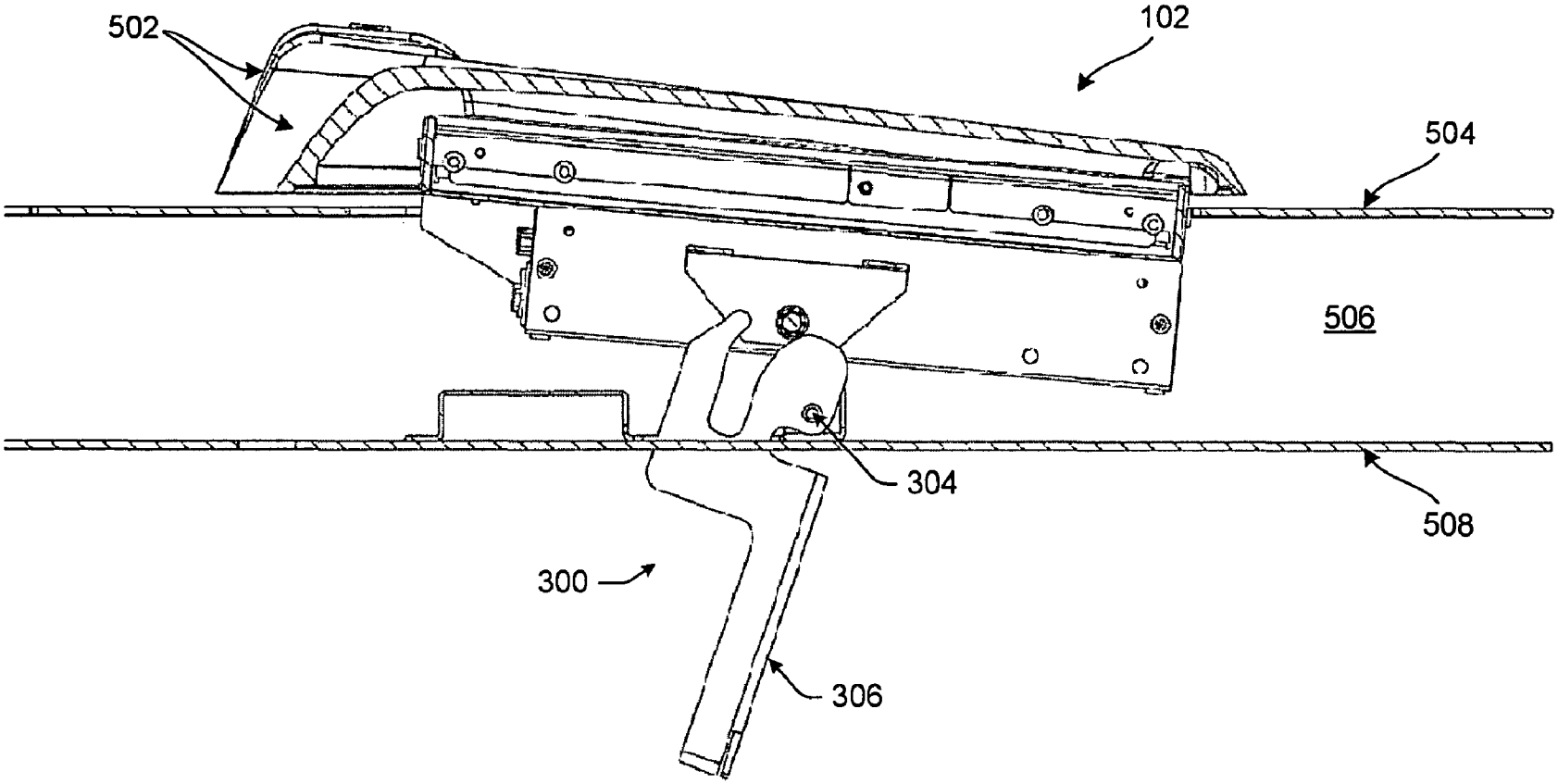
FIG. 5 is a diagram of an example removable player station and an example pivoting latch in a position for receiving or releasing the removable player station.

FIG. 5 shows the removable player station 102 being engaged by a latch 300 of the cradle 400. As shown, the lever 306 of the latch 300 or cradle 400 is in an open or unsecured position for either receiving or releasing the removable player station 102.

The removable player station 102 may include a top piece, such as a cosmetic frame 202 that constitutes the visible edge of the removable player station 102 that a player sees above the top surface 504 of a tabletop 506 of the electronic game table 100. The visible and accessible part of the latch 300, cradle 400, or other latching mechanism may be located underneath the bottom surface 508 of the tabletop 506, away from view of the players.

When the cradle 400 pivots to a locking position, the latch (es) 300 of the cradle 400 may be leveraged to pull, via the housing 204, the cosmetic frame 202 of the removable player station 102 into firm contact with the top surface 504 of the tabletop 506.

In an electronic game table 100 for multiple players, each player position at the table 100 has a respective opening for the removable player station 102 at that position. Each latch 300 or cradle 400 includes a pivotable attachment for attaching to the electronic game table 100 within a respective opening in the tabletop 506.

Figure 6:
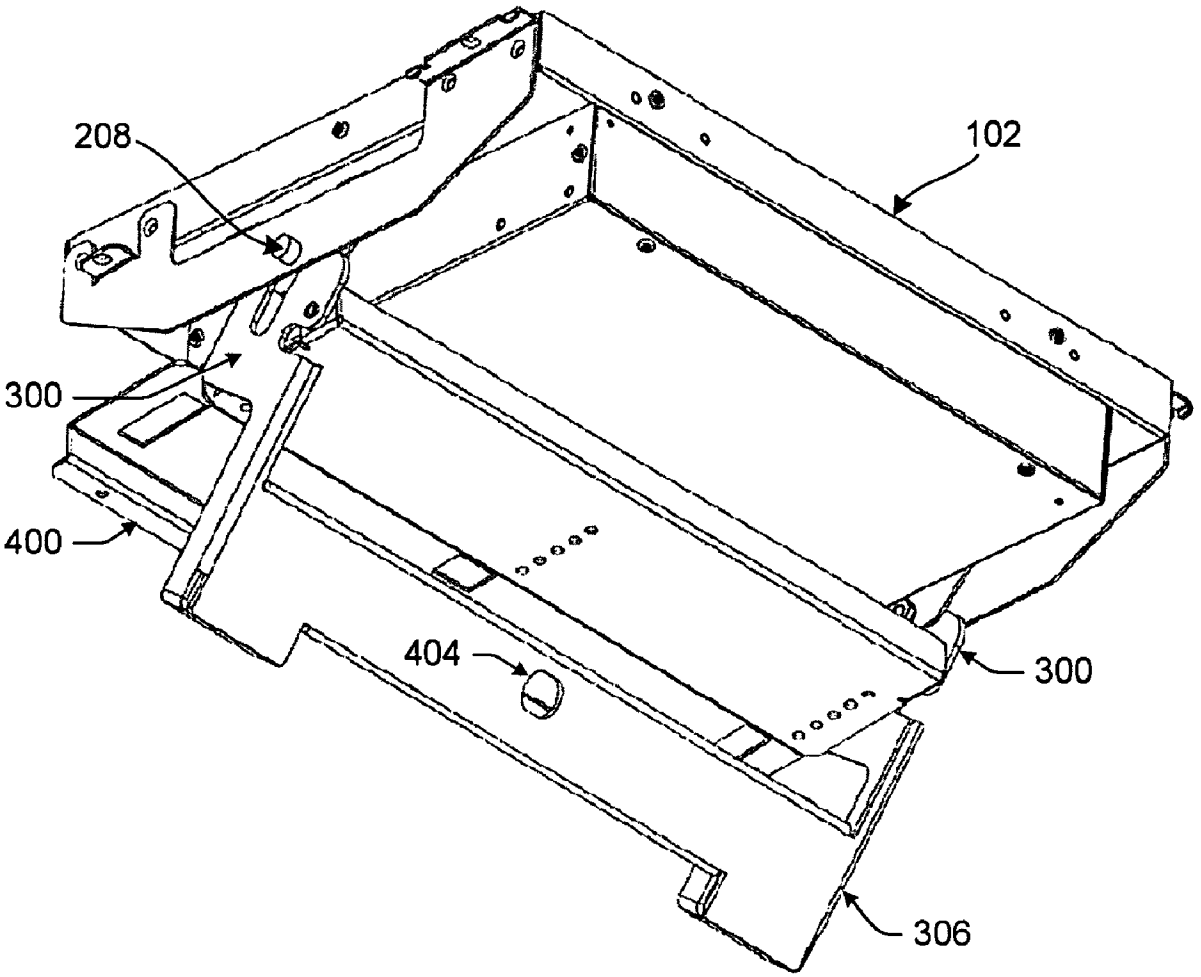
FIG. 6 is a perspective view of an example removable player station and an example pivoting cradle in a position for receiving or releasing the removable player station.

FIG. 6 shows a perspective view of the removable player station 102 and a cradle 400 latching mechanism in open position for receiving or releasing the removable player station 102. Both latches 300 have engaged respective receiving members 208. In one implementation, a lock opening 404 allows a lock that is attached to the electronic game table 100 to secure the lever 306 of the cradle 400 when the lever is closed in a seated position. In another implementation, the lock mechanism resides on the cradle 400, and engages a lock opening, latch plate, fastener, etc., on the electronic game table 100.

Figure 7:
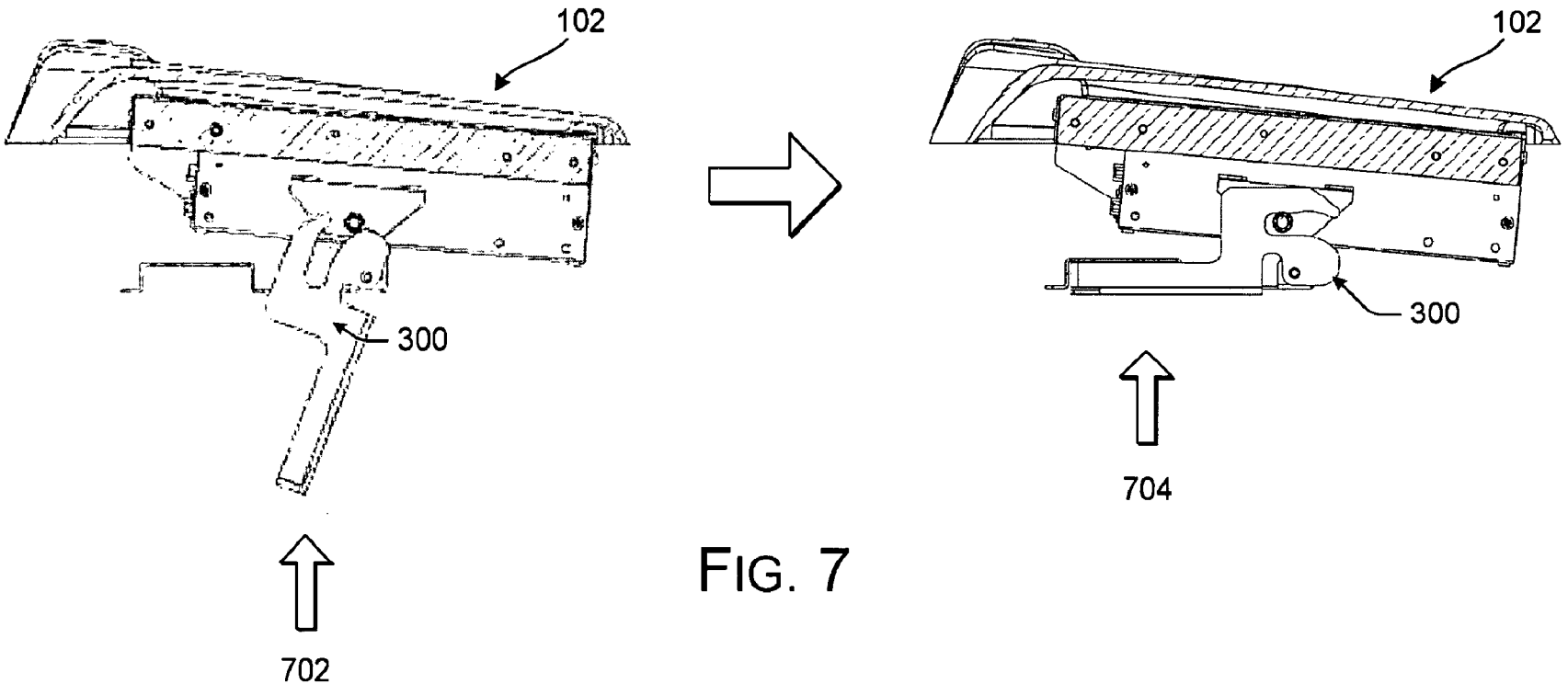
FIG. 7 is a diagram of an example removable player station and latching mechanism, showing transition from a first position of the latching mechanism for receiving the removable player station to a second position for seating and locking the removable player station.

FIG. 7 shows an example removable player station 102 and latching mechanism, in transition from a first position 702 of a latch 300 to a second position 704 of the latch 300. In the first position 702, the latch 300 allows the removable player station 102 to be received by or removed from the electronic game table 100. In the second position, 704, the latch 300 is seated and enables locking to secure the removable player station 102.

The shown latch 300 or cradle 400 pivots to secure the removable player station 102 to the electronic game table 100. In alternative implementations, alternative latching mechanisms slide, twist, screw, or magnetically capture the housing 204 of the removable player station 204. A preferred embodiment is the locking quick-release cradle 400 with multiple latches 300 shown in FIGS. 2-9.

Figure 8:
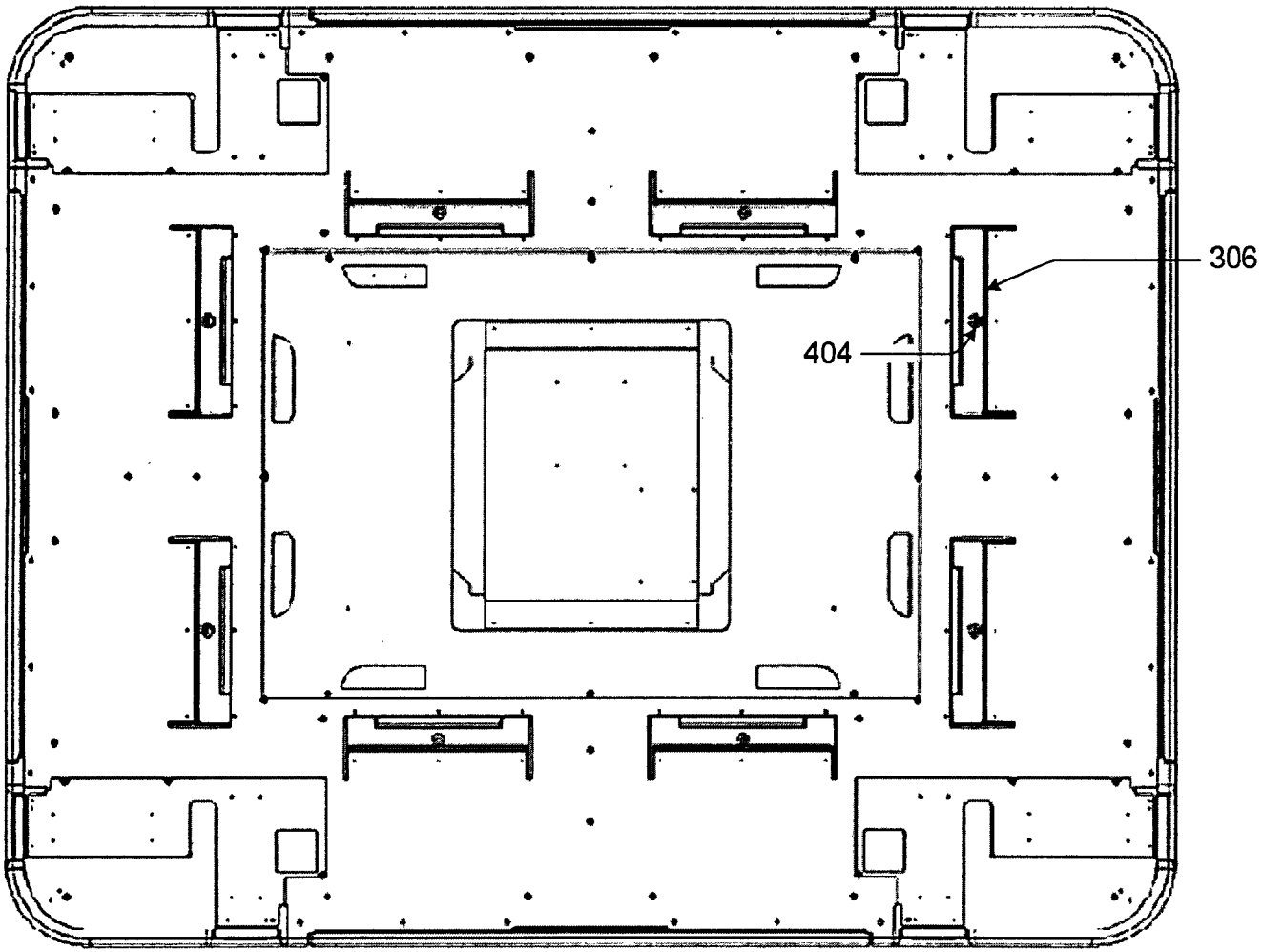
FIG. 8 is a diagram of the bottom of the example electronic game table of FIG. 1, showing accessible locking parts of multiple latching mechanisms for securing multiple removable player stations.

FIG. 8 shows an example underside arrangement of the example electronic game table 100 of FIG. 1. Each player position at the table 100 has a corresponding removable player station 102. In one implementation, on the underside of the table 100, only the lever 306 and lock/lock opening 404 of each cradle 400 are visible and accessible. The visible and accessible parts of each cradle 400 are hidden from normal view of players at the table. In alternative implementations, the latching mechanism for securing a removable player station 102 to an electronic game table 100 can be accessible from the top of the table 100 or from a side rail of the table.

Figure 9:
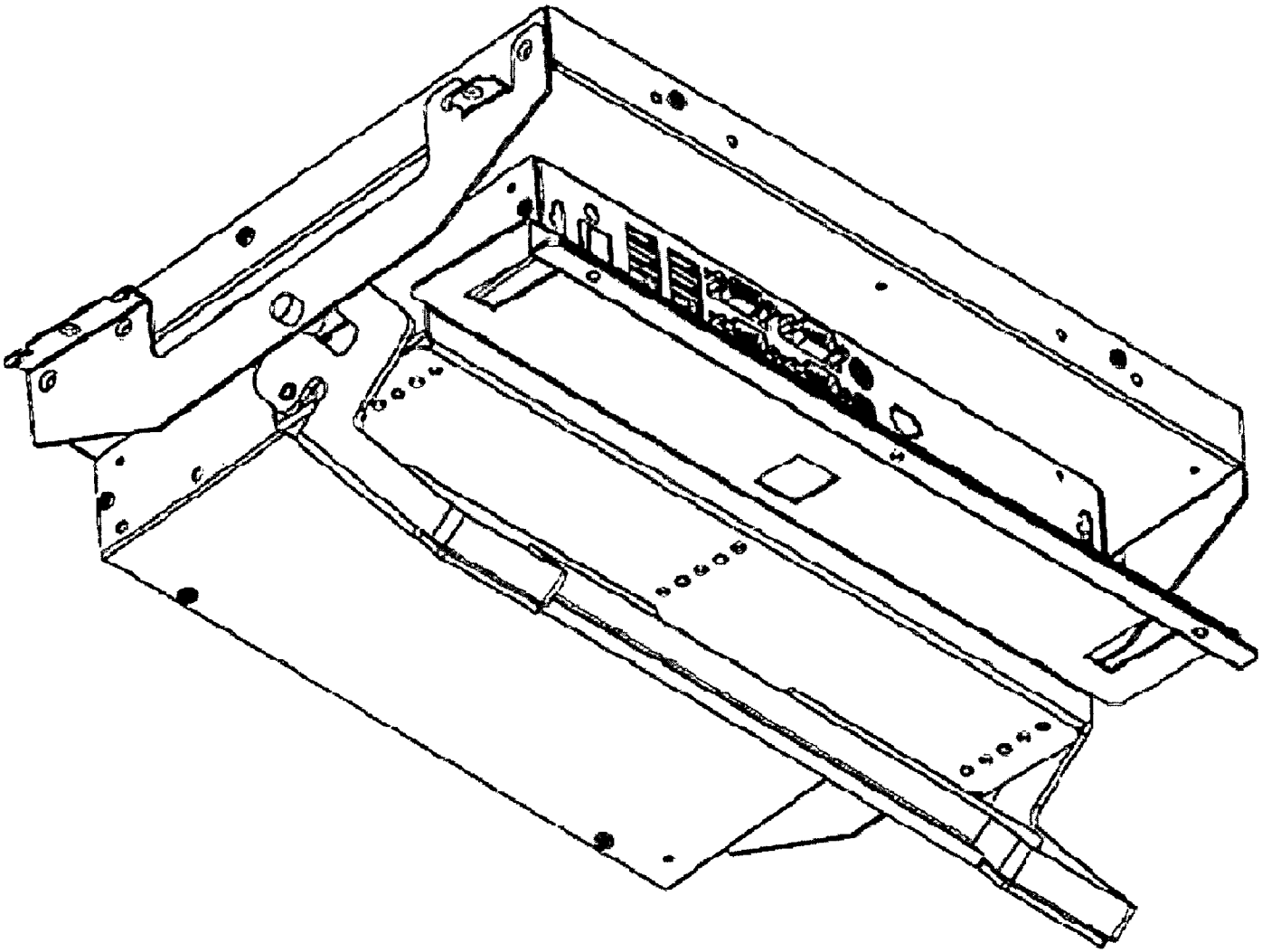
FIG. 9 is a perspective diagram of an example removable player station that includes computing device components, showing communication ports and a power connection.

FIG. 9 shows a perspective view of an example removable player station 102 that includes computing device components, including communication ports and a power connection. In one implementation, a cable and quick-release plug consolidate two or more connections into a single connector for quick connection or release of the removable player station 102. For example, a quick release cable with combined plugs may consolidate a power connection and an Ethernet connection; or may consolidate a power connection and a USB connection.

Conclusion

Although exemplary systems have been described in language specific to structural features and/or methodological acts, it is to be understood that the subject matter defined in the appended claims is not necessarily limited to the specific features or acts described. Rather, the specific features and acts are disclosed as exemplary forms of implementing the claimed systems, methods, and structures.

The invention claimed is:

1. A removable player station for an electronic game table, comprising:

a housing to include at least a video display;

at least one receiving member attached to the housing for receiving a latch to removably secure the housing to the electronic game table; and wherein the housing includes multiple receiving members on more than one side of the housing to secure the housing to the electronic game table at multiple points on the housing.

2. An electronic game table, comprising:

an opening in a tabletop of the electronic game table, fitted to receive a removable player station; and a latching mechanism associated with the opening to removably secure the removable player station to the electronic game table.

3. The electronic game table as recited in claim 2, wherein the latching mechanism comprises a cradle that includes multiple latches for securing the removable player station at multiple points to the electronic game table.

4. The electronic game table as recited in claim 3, wherein the cradle pivots to engage receiving members on multiple sides of the removable player station.

5. The electronic game table as recited in claim 4, wherein the cradle includes a lock.

6. The electronic game table as recited in claim 5, wherein the cradle secures the removable player station to the electronic game table by pivoting to a locking position at which the cradle is lockable to the electronic game table.

7. The electronic game table as recited in claim 6, wherein when the cradle pivots to a locking position, the cradle pulls a cosmetic frame of the removable player station into contact with the tabletop of the electronic game table.

8. The electronic game table as recited in claim 6, wherein when the cradle pivots from a locking position, the cradle lifts the removable player station from a seated position for manual removal from the electronic game table by a human operator.

9. An apparatus, comprising:

a cradle for pivotable attachment to an electronic game table; and at least one latch on the cradle for engaging a receiving member on a removable player station, the latch for removably securing the removable player station to the electronic game table.

10. The apparatus as recited in claim 9, wherein the cradle includes a pivotable attachment for attaching to the electronic game table within an opening in a tabletop of the electronic game table.

11. The apparatus as recited in claim 10, wherein the pivotable attachment enables the cradle to pivot between a first position for receiving the removable player station to the electronic game table and releasing the removable player station from the electronic game table; and a second position for seating the removable player station in the electronic game table and locking the removable player station to the electronic game table.

12. The apparatus as recited in claim 11, wherein when the cradle pivots to the second position, the cradle pulls a cosmetic frame of the removable player station into contact with the tabletop of the electronic game table.

13. The apparatus as recited in claim 11, wherein when the cradle pivots from the second position to the first position, the cradle lifts the removable player station for manual removal from the electronic game table by a human operator.

14. The apparatus as recited in claim 9, further comprising a lock attached to the cradle for securing the cradle to the electronic game table in a cradle position that seats the removable player station in the electronic game table and locks the removable player station to the electronic game table.

15. The apparatus as recited in claim 14, wherein the accessible part of the lock is located under an electronic game tabletop away from view of a player.

16. The apparatus as recited in claim 9, wherein the cradle includes multiple latches for engaging multiple receiving members on the removable player station; and wherein the multiple latches removably secure the removable player station to the electronic game table at multiple points on the removable player station.

* * * * *